United States Patent [19]

Swendeman

[11] 4,432,279

[45] Feb. 21, 1984

[54] CAN FLATTENER

[75] Inventor: Jim M. Swendeman, New Braunfels, Tex.

[73] Assignee: Reynolds Metals Company, Richmond, Va.

[21] Appl. No.: 422,656

[22] Filed: Sep. 24, 1982

[51] Int. Cl.[3] ..... B30B 3/04

[52] U.S. Cl. ..... 100/171; 100/902; 241/236

[58] Field of Search ..... 100/158 R, 158 C, 162 R, 100/163, 171, 902, 98 R, 177; 72/190, 191, 197; 241/113, 236, 293

[56] References Cited

U.S. PATENT DOCUMENTS

| | | | |
|---|---|---|---|
| 27,830 | 4/1860 | Powell | 100/162 |
| 657,761 | 9/1900 | Davison | 100/162 R |
| 673,768 | 5/1901 | Fleming | 241/236 |
| 1,709,552 | 4/1929 | Beall . | |
| 2,121,453 | 6/1938 | Sundstrand | 241/236 X |
| 2,533,139 | 12/1950 | Polk, Sr. et al. | 146/3 |
| 2,538,590 | 1/1951 | Polk, Sr. | 100/171 X |
| 2,895,864 | 7/1959 | Richardson | 100/158 R X |
| 3,749,004 | 7/1973 | Pagdin et al. | 100/50 |
| 3,780,646 | 12/1973 | Ancellin | 100/162 R X |
| 3,827,351 | 8/1974 | Rosenow | 100/176 |
| 4,059,050 | 11/1977 | Davis, Jr. | 100/91 |
| 4,195,562 | 4/1980 | Mickler | 100/39 |
| 4,257,511 | 3/1981 | Miller | 194/4 R |

FOREIGN PATENT DOCUMENTS

| | | | |
|---|---|---|---|
| 2059804 | 4/1981 | United Kingdom | 241/236 |

*Primary Examiner*—Billy J. Wilhite
*Assistant Examiner*—Christine A. Peterson
*Attorney, Agent, or Firm*—Alan T. McDonald

[57] ABSTRACT

A flattener for beverage cans is disclosed. The flattener comprises a rotating drum and a series of roller assemblies mounted in a converging arc with respect to the drum to provide a progressively decreasing nip between the roller assemblies and the drum between which the cans may be flattened.

8 Claims, 3 Drawing Figures

CAN FLATTENER

BACKGROUND OF THE INVENTION

With the increasing concerns for the environment and resource recovery in the past several years, recycling of cans, and especially aluminum cans, for recovery of the metal and subsequent remelting and reuse of the metal has become commonplace.

Typically, consumers bring empty cans to a mobile or permanent recycling facility, where the cans are weighed and the customer is paid for the weight of the cans delivered. More recently, mechanical devices, sometimes referred to as "reverse vending machines", have begun to appear. These machines accept cans from consumers, weigh the cans and pay out the appropriate renumeration therefore.

Whether the cans have been collected at a permanent, mobile or mechanical collection facility, the cans must eventually be transported to a smelter, where the cans are remelted and new molten metal, ingots or sheet is produced.

To efficiently and economically transport cans from one location to another, and especially when transporting large numbers of cans to a smelter, it is highly desirable that the cans be flattened, thus reducing their volume and increasing the number of cans which may be transported in a single truck or other transporting unit. Therefore, numerous can flatteners have been developed in the past.

While commercially acceptable flatteners have been produced, the currently available flatteners each have one or more problems associated therewith. Many flatteners are quite large, eliminating their use as a part of a reverse vending machine or in a mobile recycling center. There are units that require high frictional resistance, thus increasing energy cost. Some flatteners do not consistantly flatten, i.e., they tear and flatten, and thereby do not offer effective can density. Then there are those that say they are flatteners, but only offer a somewhat crushed can, unable to justify their use as a high density flattener unit.

It is thus a primary objective of the present invention to produce a can flattener which is free from the defects common to currently available units.

THE PRESENT INVENTION

By means of the present invention the above-stated objectives are obtained. The can flattener of the present invention consists of a driven flattening drum and a driven flattening roller unit. The roller unit includes a plurality of roller assemblies which are supported in a converging arc to form a tangent with the drum at the final roller assembly, thereby forming a progressively decreasing nip between the roller assemblies and the drum. Each roller assembly is comprised of a series of spaced disks arranged in a row. The disks of all but the last roller assembly, which assembly forms the tangent and the final nip with the drum, have a chordal portion of each disk removed to provide a slightly opened nip, allowing the cans relief before being firmly grasped within the nip.

The roller unit is spring loaded to permit solid objects, such as rocks and the like, to pass through the flattener without damage to the unit.

The flattener is compact enough to enable it to be used in a reverse vending machine, is sturdy enough to be used in a commercial location and is self-clearing and nonjamming and does not mangel or tear cans, thus reducing down time and providing a safe operation. The unit also produces a can density sufficiently high for economic commercial operation.

BRIEF DESCRIPTION OF THE DRAWINGS

The can flattener of the present invention will be more fully described with reference to the drawings in which.

DETAILED DESCRIPTION OF THE PREFERRED EMBODIMENT

Figure 1:
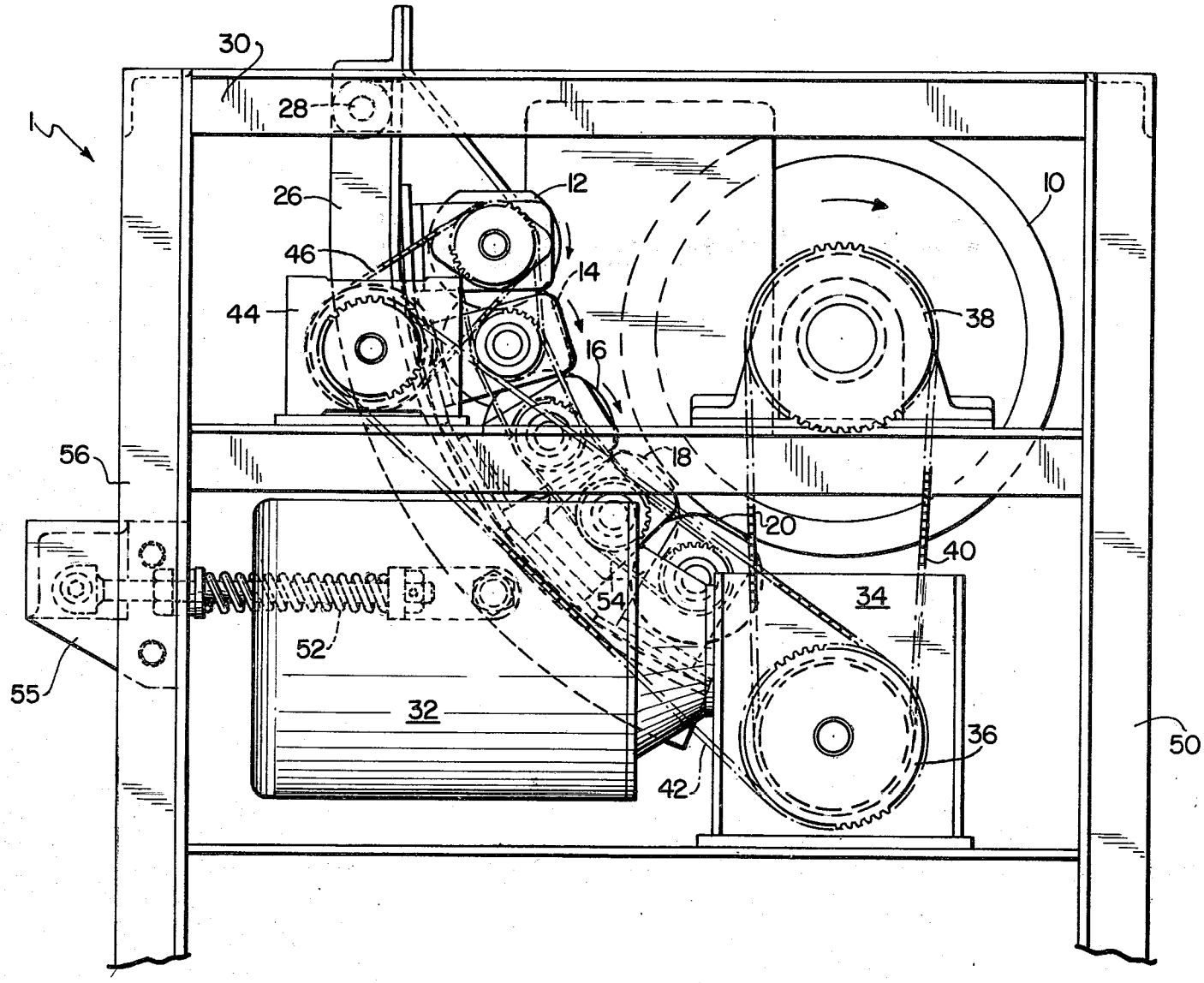
FIG. 1 is a side elevational view of the flattener of the present invention, with the walls thereof removed.
Figure 2:
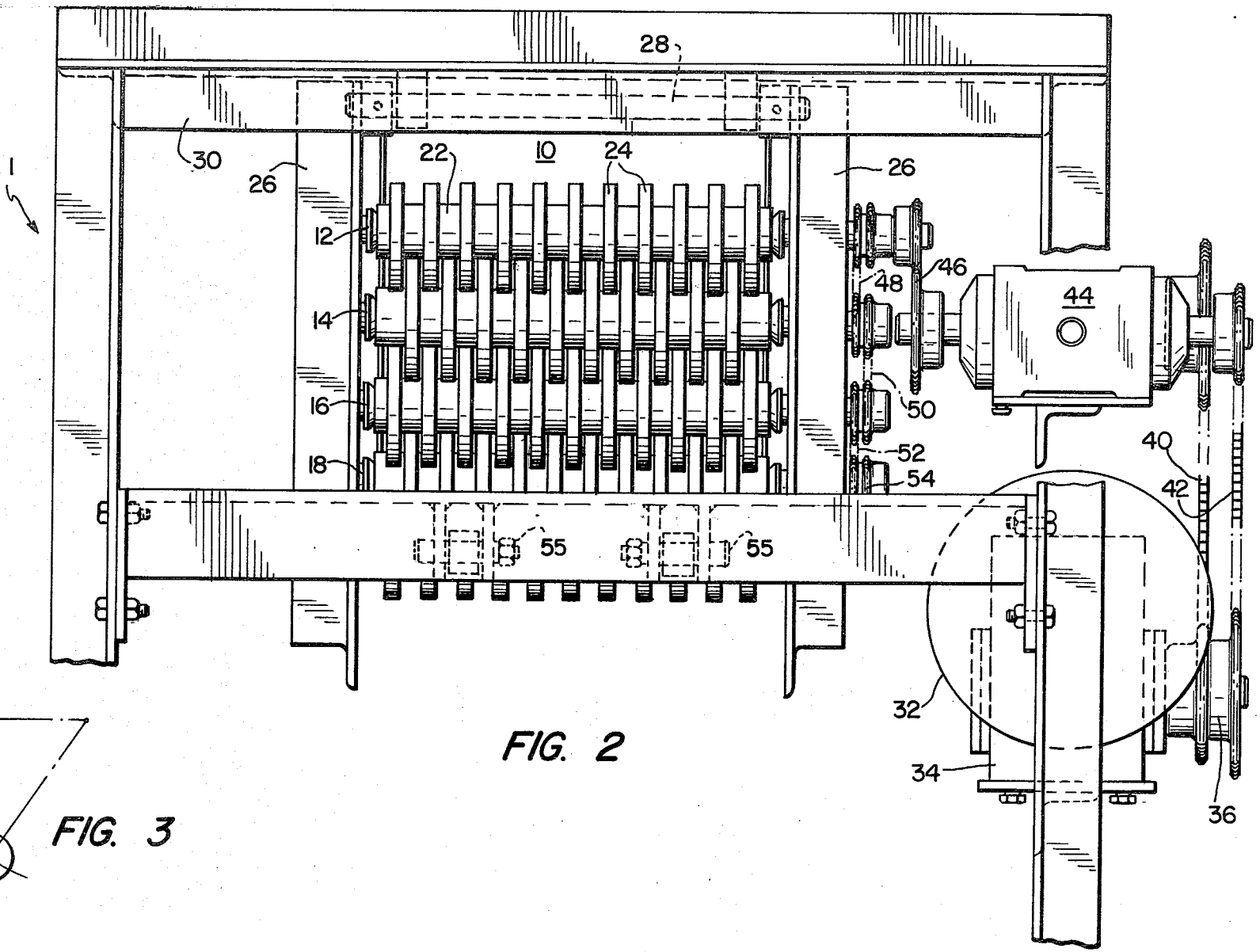
FIG. 2 is a front elevational view of the flattener, with the walls thereof removed.

Turning to FIGS. 1 and 2, the flattener 1 of the present invention is illustrated. The flattener 1 comprises a drum 10 and a plurality of roller assemblies 12, 14, 16, 18, and 20 forming a roller unit. The drum 10 may be, for example, a 12.00 inch (30.48 cm.) diameter by 12.00 inch (30.48 cm.) wide rubber coated drum. The rubber coating reduces noise and provides a resilient surface, increasing the life of the drum 10 and the roller assemblies 12, 14, 16, 18 and 20. The roller assemblies 12, 14, 16, 18 and 20 each comprise shafts 22 with spaced roller disks 24 mounted thereon. As can best be seen in FIG. 2, the spaced disks 24 of each roller assembly 12, 14, 16, 18 and 20 are interleaved, i.e., spaces between disks in one roller assembly are filled by disks from the preceding and/or subsequent roller assembly. This spaced and interleaved orientation aids in preventing jams, as will be described below.

The roller assemblies 12, 14, 16, 18 and 20 are pivotedly mounted as a unit by means of a mounting arm 26, through pin 28 mounted upon frame member 30. The roller assemblies 12, 14, 16, 18 and 20 are mounted on pivotable arm 26 in an arculate manner, with the radius of the arc being approximately equal to the diameter of the drum 10, and the mounting of the arm 26 being such that a converging nip is formed between the drum 10 and the roller assemblies 12, 14, 16, 18 and 20, with the final roller assembly 20 being tangent to drum 10.

In operation, cans enter the flattener 1 through a chute (not shown) in frame 30 and are initially received between drum 10 and roller assembly 12. The cans may arrive from any of numerous pieces of apparatus, such as weigh hoppers, discharge chutes, and the like. Drum 10 rotates in a counter clockwise direction, while the roller assemblies 12, 14, 16, 18 and 20 rotate in a clockwise direction, forcing the cans between the progressively decreasing nip therebetween.

Motor 32 provides the driving force for the flattener 1. Motor 32 is connected to gear box 34, which, by means of pulleys 36 and 38 and chain or belt 40, rotates drum 10. Pulley 36 also has mounted thereon a second chain or pulley 42 which is connected to a right angle gear box 44. This gear box is in turn connected by means of belt or chain 46 to roller assembly 12. The roller assemblies 12, 14, 16, 18 and 20 are driven at approximately the same linear speed as drum 10 by means of chains or belts 48, 50, 52 and 54 mounted therebetween. Thus, motor 32 provides the driving force for all moving parts of the system.

Figure 3:
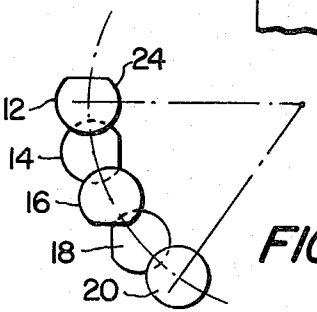
FIG. 3 is a diagramatic representation of the orientation of the roller assemblies with respect to one another in the roller unit.

As can best be seen in FIG. 3, the disks 24 on each of roller assemblies 12, 14, 16 and 18 have a chordal portion removed therefrom. The chordal portions of each disk 24 on a given roller assembly 12, 14, 16 and 18 are positioned to provide a single flat across the roller assembly and chordal portions of roller assemblies 12, 14, 16 and 18 are offset approximately 90° from one another. The chordal portions on the disks 24 provide flats or areas of relief in the nip between the roller assemblies and drum 10. These flats aid in progressing the cans through the nip without the cans resisting forward motion. Further, the chordal portions of the roller assemblies 12, 14, 16 and 18 enter into the areas of common overlap between adjacent roller assemblies, providing a wiping action, thus preventing cans from wrapping around the disks 24 and jamming flattener 1.

The disks 24 on roller assembly 20 have no flats or chordal portions removed therefrom. In addition, roller assembly 20 is mounted tangent to drum 10. This provides for high density compaction of the cans. After compaction, the cans exit through a chute opening in the sheet metal covering front frame 50 (not shown), where the cans may be directed to a container or, through means, such as a blower and piping, transported to a remote collector.

While designed for cans only, it is probable that objects not so easily compacted may inadvertently enter the system. To account of this, arm 26 carrying the roller unit is pivotedly mounted and tension loaded, such as by means of adjustable spring 52 and mounting 55 on frame 56. Spring 52 maintains the tangential contact between roller assembly 20 and drum 10 when cans are passed through the system, providing the force necessary for dense compaction of the cans to a level of up to about 10.1 pounds per cubic foot (160.2 kilograms per cubic meter). However, should a non-compressive element, such as a rock, cast part, or the like enter flattener 1, its resistance to compaction would overcome the force of spring 52, thus pivoting arm 26 about pin 28, allowing the foreign object to pass through the system without damage to the flattener 1.

As can be seen from the foregoing, the can flattener of the present invention is simple in construction, provides densely compacted cans, substantially reduces the changes for jamming of the system by wrapping of the cans and the like, and is energy efficient and compact in size, due to its single motor, low frictional resistance operation.

While the flattener has been described with respect to certain specific embodiments thereof, it is not intended to be so limited thereby, except as set forth in the accompanying claims.

I claim:

1. a can flattener comprising a rotatable drum, a plurality of rotatable roller assemblies and means for rotating said drum and said roller assemblies, said roller assemblies being mounted in a converging arc with respect to said drum, with the last of said roller assemblies being tangent to said drum, thereby providing a progressively decreasing nip between said drum and said roller assemblies, each of said roller assemblies comprising a plurality of spaced disks, the disks of each roller assembly being interleaved with the disks of its immediate adjacent roller assembly or roller assemblies, the disks of each roller assembly, except the roller assembly which is tangent to said drum, having a chordal portion removed therefrom.

2. A can flattener according to claim 1 wherein the removed chordal portions of the disks of a given roller assembly are positioned to provide a single flat across said roller assembly.

3. A can flattener according to claim 2 wherein the flats of adjacent roller assemblies are positioned approximately 90° from one another.

4. A can flattener according to claim 1 wherein said means for rotating said drum and said roller assemblies comprises a motor and connecting means between said motor and said drum and said roller assemblies.

5. A can flattener according to claim 1 wherein said converging arc has a radius approximately equal to the diameter of said drum.

6. A can flattener according to claim 1 wherein said roller assemblies are pivotly mounted.

7. A can flattener according to claim 6 wherein said roller assemblies are spring tension mounted.

8. A can flattener according to claim 1 wherein said drum is rubber coated.

* * * * *